US005282353A

United States Patent [19]

Kellstrom, Jr.

[11] Patent Number: 5,282,353

[45] Date of Patent: Feb. 1, 1994

[54] CONTINUOUS SELF-NEUTRALIZING STRANDER

[76] Inventor: Gary E. Kellstrom, Jr., 345 Caldwell Ave., Paterson, N.J. 07501

[21] Appl. No.: 786,770

[22] Filed: Nov. 1, 1991

[51] Int. Cl.[5] ..... D07B 3/02; D07B 3/06

[52] U.S. Cl. ..... 57/13; 57/3; 57/59; 57/65; 57/314; 476/36

[58] Field of Search ..... 57/3, 6, 13, 59, 65, 57/314; 476/36

[56] References Cited

U.S. PATENT DOCUMENTS

| | | | |
|---|---|---|---|
| 864,039 | 8/1907 | Sponsel | 57/65 |
| 946,162 | 1/1910 | Spencer | 57/65 |
| 1,356,834 | 10/1920 | Smith | 57/59 |
| 2,802,328 | 8/1957 | Ritchie | 57/65 |
| 2,858,706 | 11/1958 | Alexandersson | 476/36 |
| 3,158,980 | 12/1964 | Carter | 57/13 |
| 3,448,569 | 6/1969 | Brown et al. | 57/65 |
| 4,574,574 | 3/1986 | Knaak | 57/3 X |

*Primary Examiner*—Daniel P. Stodola
*Assistant Examiner*—William Stryjewski
*Attorney, Agent, or Firm*—Fitzpatrick, Cella, Harper & Scinto

[57] ABSTRACT

A strander for generating a multi-strand cable including at least one pay-off station which is spaced radially from a common rotational axis along which the cable is formed. Each station includes a reel for paying-off a strand to be used in the cable, and each reel s disposed with its axis in a plane normal to a radial line from the common axis. Furthermore, each pay-off station includes a mechanism for causing the axis of the reel to rotate in the plane normal to the radial line. A stabilizer mechanism is provided for a flywheel disposed coaxially with the product reel, and a torque differential device is coupled to be driven by the reel and to drive the flywheel in a direction opposed to the rotational direction of the reel, wherein any change in the angular momentum of the reel is opposed by a change in the angular momentum of the flywheel.

21 Claims, 5 Drawing Sheets

CONTINUOUS SELF-NEUTRALIZING STRANDER

BACKGROUND OF THE INVENTION

1. Field Of The Invention

The present invention relates generally to cabling machines, or stranders, and more particularly to apparatus and a method for winding a plurality of conductor strands on a core strand to form a self-neutralized multi-strand cable, each strand being continuously free of any backtwist. The present invention finds particular utility in applications for winding small gauge or fragile strands, such as fiber optic strands. Of course, the present invention may be used with equal advantage in many other applications, such as insulated wire, steel wire, or other products requiring stranding without torsional twisting.

2. Description Of The Prior Art

Stranded cables are well known and have been used in many applications for more than a century. For example, stranded wire cables are used for structural applications, such as bridges, for electrical applications, such as electrical transmission lines, and for communications applications, such as telecommunication transmission cables. Recently, stranded fiber optic cables also have been used for various applications, including telecommunication transmission lines.

Stranders also are well known. Generally, a strander winds together a plurality of strands to form a flexible multi-strand cable. In some cases, a plurality of strands, or conductors, are wound around a center or core strand. In other applications, individual conductor strands simply are wound about each other. The individual strands typically are fed to the strander from respective reels, or bobbins.

Known stranders generally are classified in one of two categories; rigid stranders and planetary stranders. For example, U.S. Pat. Nos. 3,396,522 (Biagini) and 3,727,390 (Schwarz) disclose rigid stranders that include a plurality of reels disposed radially on a disk-shaped platform. The disk-shaped platform is mounted on a cradle and arranged for rotation about a core strand, which is drawn therethrough on a common axis. In such rigid stranders, conductor strands are unwound or payed-off from individual reels, fed along the length of the cradle to a closing device, and layed on the core strand as it is drawn through the common axis of the disk-shaped platform and strander cradle. The windings of the stranded cable are generated by rotating the disk-shaped platform about the common axis as the core strand is drawn therethrough.

Other examples of stranders include tubular stranders and bow stranders. In a tubular strander, a bunch of strands are fed through a long pipe, which is turned to twist the strands. A bow strander comprises a plurality of bow members having their ends arranged on a common axis and their bodies bowed radially outward. In a bow strander, the strands are payed-off reels which are held in cradles, and the bows are arranged to allow the strands to skip over the reels for passage through a hub.

Although rigid stranders provide utility in a number of applications, they suffer a number of drawbacks. Bow stranders generally manipulate the strands extensively through small pulleys and are limited in the number of strands that can be twisted at one time. Moreover, all rigid stranders have a drawback in that they add a twist to each strand (known as a backtwist), as the strand is wound about the other strands to form the resultant cable. This backtwist stretches the strand and degrades the tensile and shear strength of the strand, as well as the resultant cable. For small or fragile strands, such as fiber optic strands, this degradation may cause the strands or cable to fail or break. Moreover, even if the fiber optic strands do not break, a backtwist may degrade the optical transmission efficiency of a fiber optic strand because twisting alters the physical continuity of the fiber walls, and causes clouding of the transmitted signal.

Planetary stranders provide a multi-strand cable in which the individual conductor strands in the cable do not have a backtwist. For example, U.S. Pat. Nos. 2,802,328 (Ritchie), 3,010,275 (Khartmann) and 3,058,867 (Plummer) disclose planetary stranders similar to the above-described rigid stranders, wherein individual conductor strands are fed from respective reels disposed radially on a disk-shaped platform, and wherein the disk-shaped platform is mounted on a cradle for rotation about the common axis of a core strand. However, in such planetary stranders, each reel is rotatably supported on the disk-shaped platform about an axis parallel to the common axis, such that for each revolution of the platform about the common axis, each reel also rotates one revolution about its parallel axis. In this manner, the strands are payed-off from the reels, fed along the length of the cradle to a closing device, and layed on the core strand to form a twist-neutralized multi-strand cable.

Although planetary stranders have utility in many applications, known planetary stranders also have certain drawbacks. One drawback is bowing of the conductor strands during the reel unwinding operation. That is, the conductor strands are payed-off from the reels and fed along the length of the strander cradle to a closing device, centrifugal force acts on the payed-out conductor strands. These forces cause the conductor strands to bow radially outward. At low rotational speeds, this effect may be inconsequential. However, radial bowing increases as the rotational speed and radial distance from the axis of rotation increases.

Bowing also may be caused by windage. Rotation of the conductor strands at a radius about the axis of rotation creates windage for the conductor strands. Windage forces cause the strands to bow in a direction opposite the direction of rotation. Thus, bowing due to windage also increases as the rotational speed or radius increases.

It is known to reduce bowing by increasing the tension in the conductor strands. However, increasing the tension increases the likelihood of breakage or degradation of the conductor strands or cable. This is particularly true for fiber optic strands, which are fragile and subject to degradation of transmission efficiency when stretched or bent through an angle beyond their minimum bend radius. In addition, in order to maintain a quality stranded cable having consistent winding characteristics, the tension in the strands must be controlled so that it remains substantially constant. Since tension from centrifugal and windage forces in known stranders varies directly with the rotational speed and distance from the axis of rotation, these stranders generally require complex tension control devices for maintaining a constant tension over a range of rotational speeds. This is particularly true for optical fibers, which generally have a limited acceptable tension range.

It also is known to decrease bowing due to windage by feeding the conductor strands through respective guides or pipes disposed between the reels and the closing device. However, this arrangement increases the weight and complexity of the strander. Also, the energy required for rotation increases because guides and pipes are subject to windage and to radial acceleration forces caused by the centrifugal force. Moreover, the strands continue to bow radially due to the centrifugal force, and thus are subject to degradation from friction and wear of the conductor strands against the guides or pipes.

The above described drawbacks of known planetary stranders undesirably limit production speed for twist neutralized multi-strand cable. Specifically, there is a trade-off between rotational speed (thus production speed) and product quality. That is, for example, a fiber optic strand will develop a "history" with each bend to which it is subjected, and the quality of the strand will degrade with each such bend. Known planetary stranders generally are limited to operational speeds in the range of 75 to 150 RPM, with a maximum speed of about 200 RPM.

SUMMARY OF THE INVENTION

In order to overcome the drawbacks of prior stranders, it is an object of the present invention to provide a strander for generating a twist neutralized multi-strand cable, wherein bowing caused by radial acceleration forces (centrifugal force) is substantially eliminated.

It is another object of the present invention to provide a strander for generating a twist neutralized multi-strand cable, wherein bowing caused by windage is substantially eliminated.

It is another object of the present invention to provide a compact strander for generating a twist neutralized multi-strand cable, wherein the extent to which each strand is subjected to bending forces is minimized.

It is another object of the present invention to increase the manufacturing speed of a twist neutralized multi-strand cable by providing a strander operable at high rotational speeds, without sacrificing quality of the resultant cable.

These and other objects and advantages are achieved by the present invention, which provides a strander for generating a twist neutralized multi-strand cable, comprising at least one pay-off station disposed radially about a common rotational axis and arranged for rotation thereabout. Each pay-off station includes a housing for supporting a product reel, rotatably mountable thereon, for paying-off a conductor strand inwardly along a line which extends angularly from the common rotational axis. The product reel further is arranged for rotation about an axis which is orthogonal to the reel axis and which is disposed along the line extending angularly from the common rotational axis. In the preferred embodiment that orthogonal axis extends radially from the common rotational axis, thereby minimizing any tendency of the strand to bow due to centrifugal force. Means are provided for rotating the product reel one rotation about the orthogonal axis for each rotation of the pay-off station about the common rotational axis.

In another aspect of the present invention, each pay-off station is selectively attachable to a mounting disk arranged for rotation about the common rotational axis, such that the number of conductor strands twisted about the common rotational axis to form a multi-strand cable may be selected.

In another aspect of the present invention, each pay-off station housing is provided with a stabilizing tube disposed between the product reel and the common rotational axis, and rotatable about the orthogonal axis, such that a conductor strand payed-off from the product reel is fed through the stabilizing tube, and is substantially shielded from windage. Rotation of the stabilizing tube may be synchronized with rotation of the product reel about the orthogonal axis to reduce relative movement therebetween and, thus, to reduce any friction between the stabilizer tube and a strand payed-off from the product reel if they were to come in contact. In one embodiment, the product reel is mounted to the stabilizing tube to synchronize rotation therewith, and to provide structural support to the rotating product reel.

In another aspect of the present invention, a flange gear assembly is provided for synchronizing rotation of the stabilizing tube and product reel about the orthogonal axis with the rotation of the mounting disk and pay-off station about the common rotational axis, to eliminate backtwisting of each strand of the cable.

In another aspect of the present invention, a flywheel and coupling structure is provided in the pay-off station to reduce vibration generated therein at high rotational speeds. The flywheel is coupled to rotate in the direction opposite to the direction of rotation of the product reel. Specifically, in one embodiment the coupling structure includes a stationary ball cage and bearing balls for coupling rotation of the flywheel and rotation of the product reel, wherein any change in moment in the product reel is counteracted by a substantially equal and opposite change in moment in the flywheel. In this manner, the rotational moment of the product reel/pay-off assembly is stabilized to provide a constant tension pay-off of product from the product reel.

The present invention and these and many other attendant features and advantages will be readily and more completely appreciated with reference to the following detailed description of a preferred embodiment taken together with the accompanying drawing.

DETAILED DESCRIPTION OF A PREFERRED EMBODIMENT

Figure 1:
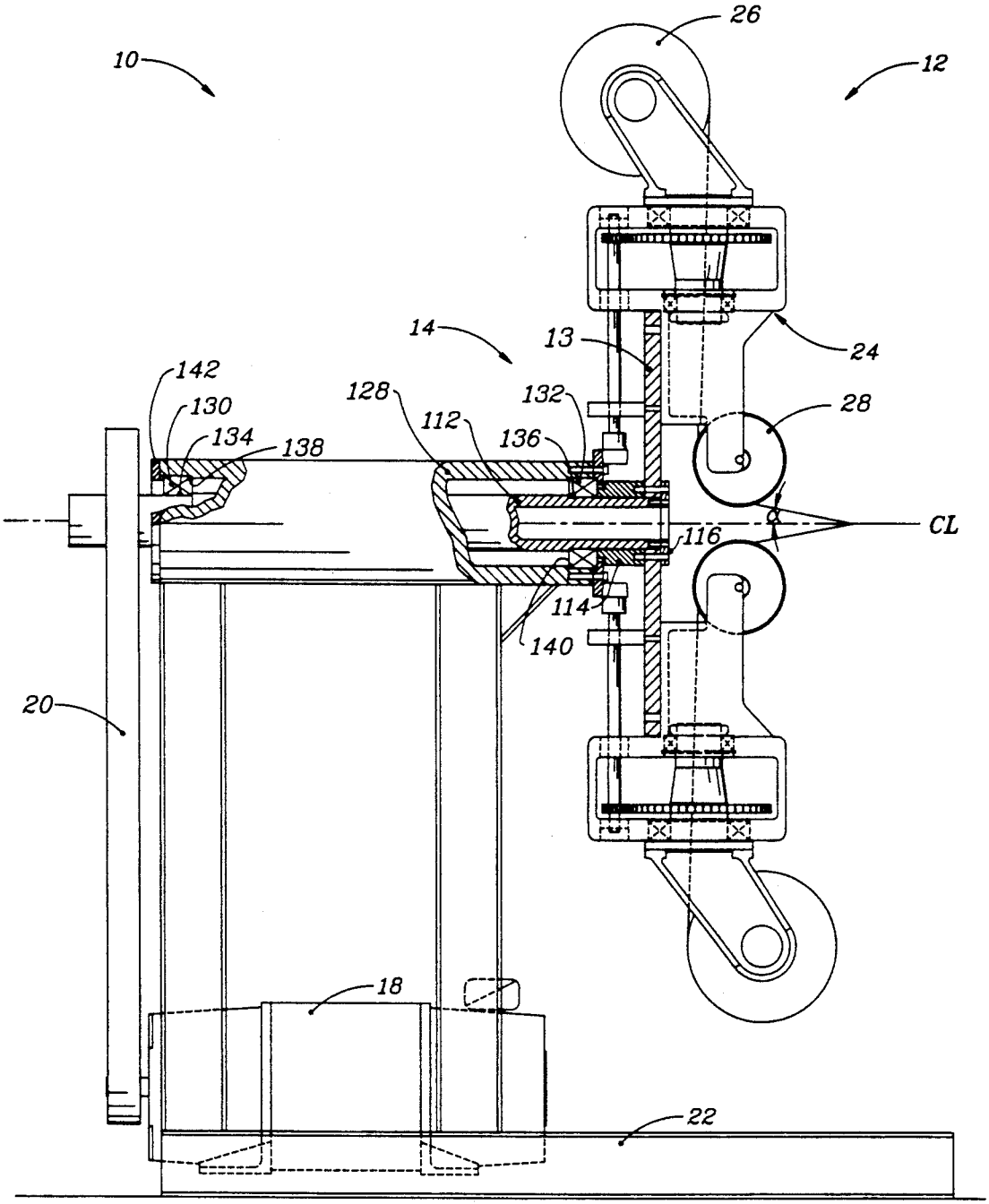
FIG. 1 is a schematic side view of a strander of the present invention, shown in partial cross-section to illustrate operation of two pay-off assemblies.

Referring now to the drawings, wherein like reference numerals designate identical or corresponding parts throughout the several figures, FIGS. 1 to 4 illustrate a preferred embodiment of a continuous self-neutralizing strander of the present invention. As shown in the figures, strander 10 generally comprises a plurality of pay-off stations 12 arranged radially on a mounting disk 13 and flange gear assembly 14. Flange gear assembly 14 is fixed to a drive shaft assembly 16, which is driven by a conventional motor 18 and drive belt 20. Pay-off stations 12, mounting disk 13, flange gear assembly 14, drive shaft assembly 16, motor 18 and drive belt 20 all are supported on a frame 22.

Figure 3:
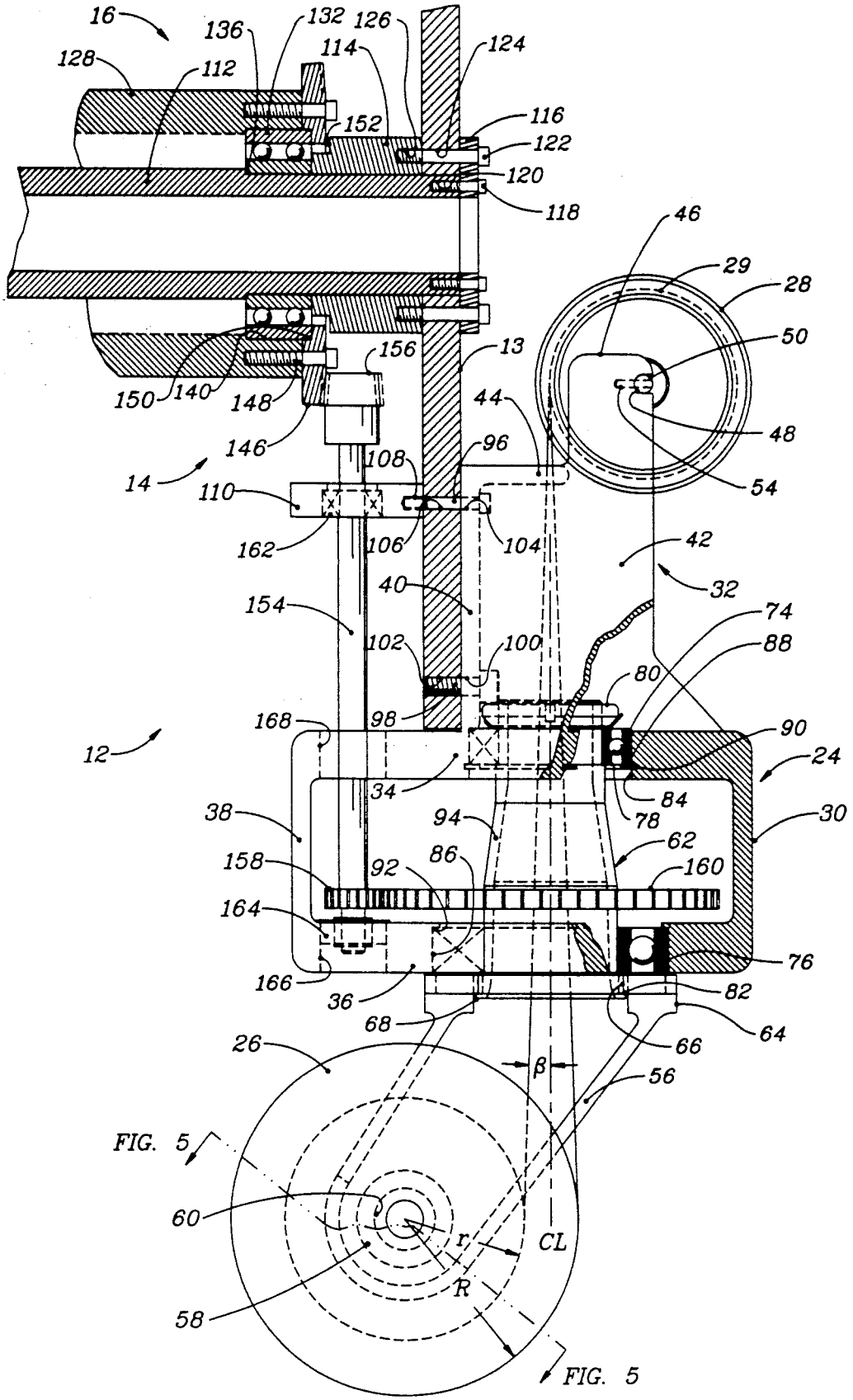
FIG. 3 is an enlarged side view of a pay-off assembly of the strander depicted in FIG. 1, shown in partial cross-section to illustrate in detail its constituent parts, including a pay-off assembly, a mounting disk, and a flange gear assembly for synchronizing rotation of a stabilizing tube, a product reel, and the pay-off assembly.
Figure 4:
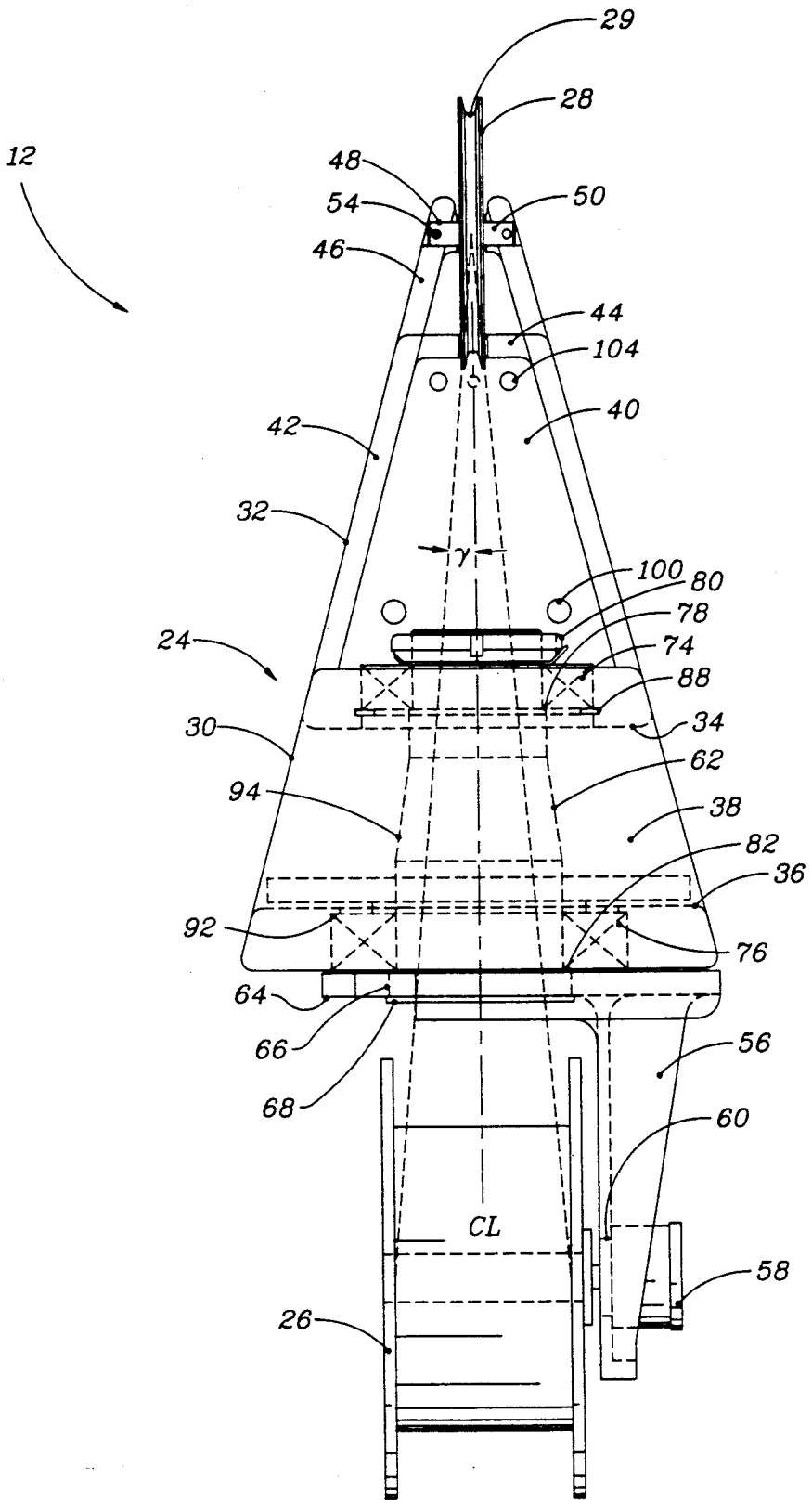
FIG. 4 is an enlarged front view of the pay-off assembly depicted in FIG. 3.

Each pay-off station generally comprises a housing 24, a product reel 26 and a strand guide member such as a sheave 28. In this regard, for example, the sheaves 28 may be replaced by a single circular toroidal surface to turn the strands from a radial direction for travel in the axial direction. Referring specifically to FIGS. 3 and 4, a pay-off station 12 of strander 10 is shown in enlarged side and front plan views, respectively. As best shown in side plan view, housing 24 comprises a base portion 30 and an inner housing portion 32. In front plan view, base portion 30 and inner housing 32 generally form an isosceles triangle, with the product reel 26 disposed adjacent base portion 30 and the sheave 28 disposed adjacent the apex of the triangle.

Referring specifically to FIG. 3, base portion 30 includes an inner wall 34, an outer wall 36 and a pair of side walls 38. In side plan view, inner wall 34, outer wall 36 and side walls 38 form an open ended channel having a rectangular cross-section. It will be appreciated that this open channel configuration provides ready access for assembly and maintenance. As discussed in greater detail below, it also helps reduce energy requirements for operation by reducing weight and wind resistance during rotation of pay-off stations 12.

Referring specifically to FIG. 4, inner housing portion 32 comprises a mounting plate 40, a pair of side support walls 42 and a cross support wall 44. In front plan view, cross support wall 44 truncates mounting plate 40 near the apex of the isosceles triangle. Side support walls 42 and cross support wall 44 each extend away from mounting plate 40, thereby forming an open box structure that provides strength and rigidity to the housing. Side support walls 42 further are provided with respective support arms 46 extending toward the apex of the isosceles triangle. Each support arm 46 is provided with a recessed notch 48 (see also FIG. 3) for receiving a sheave axle mount 50. Sheave axle mount 50 is secured in recessed notches 48 of support arms 46 by respective screws 54. Thus, as shown in front plan view, support arms 46 and sheave axle mounts 50 form an A-frame at the apex of the isosceles triangle for supporting sheave 28 in free spinning relation.

In the preferred embodiment, housing 24 is a single body structure composed of a strong, lightweight material, preferably cast aluminum. However, those skilled in the art will appreciate that housing 24 may be composed of a variety of materials depending on the stranding application.

Product reel 26 is supported for rotation about its axis by a cantilever arm 56. Specifically, product reel 26 is supported at the distal end of cantilever arm 56 by a tension brake and axle assembly 58 mounted through opening 60. In the preferred embodiment cantilever arm 56 is composed of a sturdy lightweight metal, most preferably cast aluminum, and tension brake and axle assembly 58 includes a constant torque tension brake, e.g., a precision permanent magnet tensioning brake marketed by Magnetic Technologies Ltd. As discussed in greater detail below, this arrangement helps provide accurate control of the tension in the payed-off product. Of course, the method of mounting product reel 26 for rotation on cantilever arm 56 may vary depending on the selected stranding application.

Cantilever arm 56 is rotatably mounted to base portion 30 by a stabilizing tube 62. Specifically, cantilever arm 56 is provided with a foot portion 64 having a circular opening 66, and together these elements constitute a reel support member. Stabilizing tube 62 is provided with a lipped flange 68. When stabilizing tube 62 is inserted through opening 66 of cantilever arm 56, lipped flange 68 securely engages foot portion 64. In one embodiment lipped flange 68 is provided with a notch that mates with a respective recess of foot portion 64. Thus, the notch and recess interlock cantilever arm 56 and stabilizing tube 62 for synchronized rotational movement. Of course, those skilled in the art will appreciate numerous alternative methods of registering and securely engaging stabilizing tube 58 and cantilever arm 56, such as by bonding, friction fit, key in keyway, etc. As discussed in greater detail below, secure engagement between cantilever arm 56 and stabilizing tube 62 reduces wear and degradation of the strands and cable by synchronizing rotation of stabilizing tube 62 and product reel 26.

Stabilizing tube 62 is supported in housing 24 for rotation about its axis (designated CL) by inner stabilizing bearing 74 and outer stabilizing bearing 76. Specifically, in the preferred embodiment stabilizing tube 62 is generally cylindrical in shape, and the inner and outer stabilizing bearings are single row ball bearings. As best shown in FIG. 3, inner stabilizing bearing 74 is seated on inner annular step 78 of stabilizing tube 62, and is securely fastened thereon by bearing nut 80. Outer stabilizing bearing 76 is seated on outer annular step 82 of lipped flange 68. When stabilizing tube 62 is inserted within base portion 30, inner stabilizing bearing 74 is disposed within recess 84 of inner wall 34, and outer stabilizing bearing 76 is disposed within recess 86 of outer wall 36. Inner stabilizing bearing 74 then is registered and securely supported within housing 24 by a snap ring 88, which is removably disposed within recess 90 of inner wall 34. Thus, when stabilizing tube 62 is fully inserted, and inner stabilizing bearing 74 is secured and registered by snap ring 88, outer stabilizing bearing 76 is automatically registered and securely seated between outer annular step 82 and an annular retaining step 92 of outer wall 36.

The composition and configuration of stabilizing tube 62 may vary depending on the selected stranding application. Generally, stabilizing tube 62 is composed of a sturdy material, preferably steel. Also, as noted above, stabilizing tube 62 generally is cylindrical in shape. However, in the embodiment of FIGS. 1 to 4, stabilizing tube 62 is provided with a tapered midsection 94, i.e., tapered from the end proximate cantilever arm 62 to the end proximate upper housing portion 32. It will be appreciated that the taper serves several functions. For example, this tapered configuration provides for easy insertion and removal of the stabilizing tube assembly for maintenance. Also, since inner stabilizing bearing 74 and outer stabilizing bearing 76 have different diameters, the tapered configuration provides structural rigidity and stability to stabilizing tube 62. The tapered configuration also reduces wind resistance during rotation of pay-off station 12 about the common rotational axis. Those skilled in the art will readily appreciate alternative arrangements and modifications for removably and securely supporting a product reel and stabilizing tube assembly for rotation.

Sheave 28 includes a guide slot 29 for guiding a conductor strand from a direction substantially orthogonal to the common rotational axis to a direction forming an angle $\alpha$ with the common rotational axis (See FIG. 1). In the embodiment of FIGS. 1 to 4, sheave 28 is composed of a lightweight plastic suitable for handling fiber optic strands, e.g., UHMW plastic. However, the composition of sheave 28 may vary depending on the stranding application.

The sizing of sheave 28 also may vary depending on the particular stranding application. The minimum radius of sheave 28 is determined by the minimum bend radius, if any, of the conductor strands. The maximum radius of sheave 28 generally is limited by the distance between sheave axle mount 50 and cross support wall 44. In the preferred embodiment, as best shown in FIG. 3, the sheave is positioned to align guide slot 29 with axis CL of stabilizing tube 62. As discussed in greater detail below, with such alignment, a conductor strand is fed from product reel 26 to sheave 28 in a radial direction substantially orthogonal to the common rotational axis.

Referring now to FIGS. 1 and 3, each pay-off station 12 is mounted on mounting disk 13 for rotation about the common rotational axis. In one embodiment, as shown in FIG. 3, mounting plate 40 of pay-off assembly 12 is fixed to mounting disk 13 by inner mounting bolts 96 and outer mounting bolts 98. Specifically, outer mounting bolts 98 are inserted through outer mounting holes 100 of mounting plate 40, and terminate in threaded recesses 102 of mounting disk 13. Inner mounting bolts 96 are inserted through inner mounting holes 104 in mounting plate 40 and through bearing mount registration holes 106 in mounting disk 13. Inner mounting bolts 96 then terminate in threaded recesses 108 of a bearing mount 110.

Figure 2:
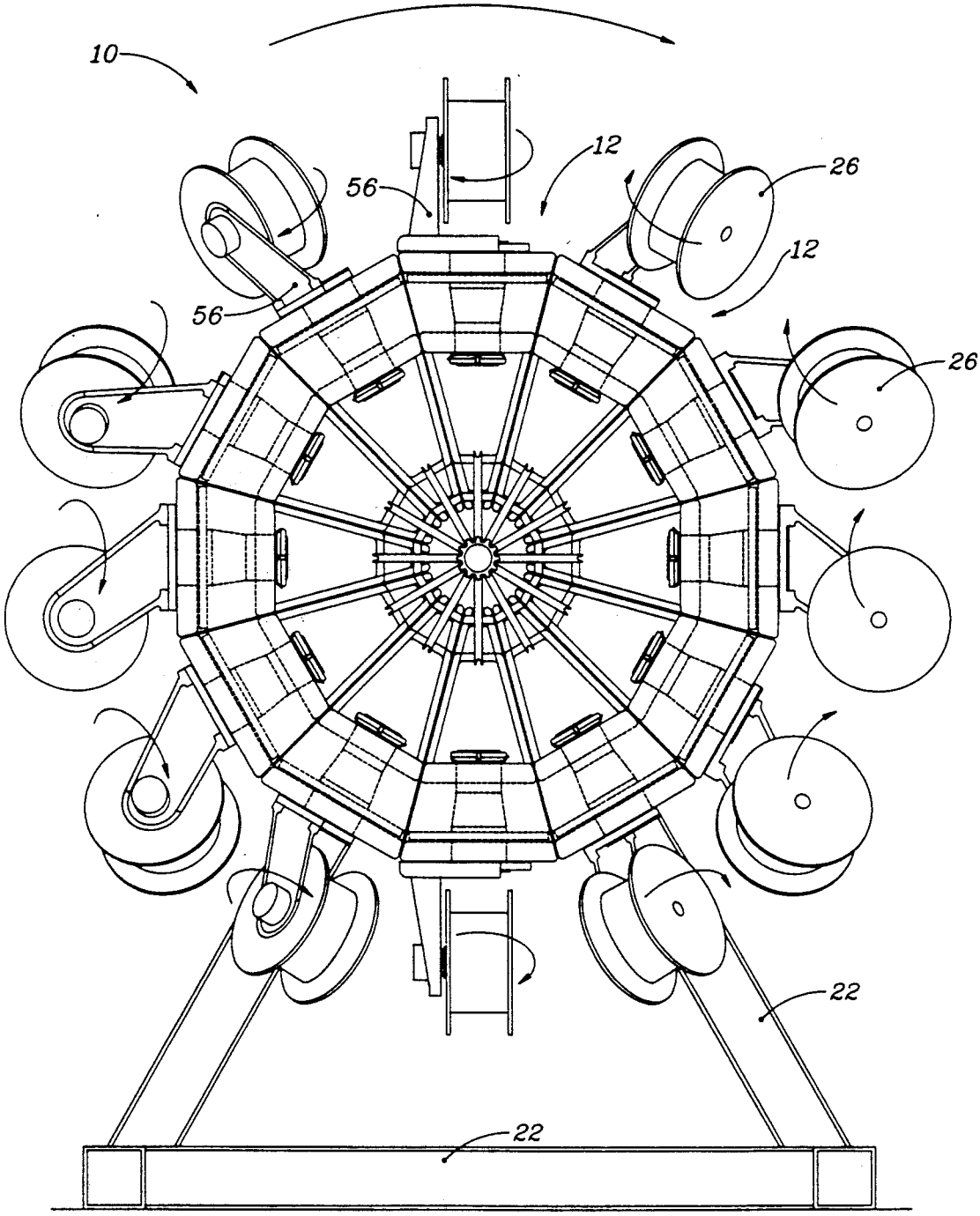
FIG. 2 is a schematic front view of the strander depicted in FIG. 1, illustrating a strander configuration having twelve pay-off stations.

The composition and configuration of mounting disk 13 may vary depending on the stranding application. In the embodiment of FIGS. 1 to 4, mounting disk 13 is composed of a sturdy, lightweight material, preferably cast aluminum, and forms a twelve-sided regular polygon. Thus, as best shown in FIGS. 1 and 2, mounting disk 13 accommodates twelve pay-off stations 12 arranged in a ferris wheel configuration, where the apex angle of each isosceles-triangle-shaped housing 24 is 30 degrees. It will be appreciated that in this configuration adjacent housings 24 abut and mutually provide additional structural support to these strander elements during rotation.

Mounting disk 13 is secured to drive shaft 112 by an internal flange member 114 and an external flange member 116. In one embodiment, as best shown in FIG. 3, external flange member 116 is fixed to the distal end of drive shaft 112 by inner flange screws 118, which terminate in threaded recesses 120 of drive shaft 112. External flange member 116 also is fixed to internal flange member 114 by outer flange screws 122, which are inserted through flange mount holes 122 in mounting disk 13, and terminate in threaded recesses 126 of internal flange member 114. In the preferred embodiment, inner flange member 114 and outer flange member 116 are composed of a sturdy material, most preferably steel. It will be appreciated that this configuration provides both ready access for maintenance and secure engagement for operation. Of course, those skilled in the art will appreciate that mounting disk 13 may be securely affixed to the distal end of drive shaft 112 by other conventional means.

Drive shaft 112 is supported for rotation within shaft housing 128 by a pair of drive shaft bearings 130, 132. In the preferred embodiment, drive shaft 112 and shaft housing 128 each are composed of rigid tubing, preferably steel tubing, and are arranged concentric with the common rotational axis. Drive shaft bearings 130, 132 are disposed between drive shaft 112 and shaft housing 128 in respective drive shaft bearing recesses 134, 136 and housing bearing recesses 138, 140. In the preferred embodiment, shaft bearings 130, 132 are double row ball bearings.

In one embodiment, as shown in FIG. 1, drive shaft bearing 130 is retained in drive shaft bearing recess 134 and housing bearing recess 138 by a conventional end cap and pre-load spring assembly 142. In this embodiment, the end cap preferably is composed of steel. Drive shaft bearing 132 is retained in drive shaft bearing recess 136 and housing bearing recess 140 by internal flange member 114 and ring bevel gear 146. Specifically, ring bevel gear 146 is fixed to the distal end of shaft housing 128 by bolts 148, and is provided with an annular recess 150, for seating and registering drive shaft bearing 132. Internal flange member 114 is provided with an annular step 152, for registering drive shaft bearing 132. Thus, as shown in FIG. 3, drive shaft 112, internal flange member 114, shaft housing 128 and ring bevel gear 146 cooperate to form an annular chamber having a generally rectangular cross-section for securely housing shaft bearing 132. Of course, those skilled in the art readily will appreciate other embodiments for supporting drive shaft 112 for rotation within shaft housing 128.

Referring again to FIGS. 1 and 3, synchronized rotation of stabilizing tube 62, cantilever arm 56 and product reel 26 about orthogonal axis CL is effected by a pinion gear assembly, generally including a pinion drive shaft 154, having a pinion bevel gear 156 and a pinion spur gear 158, and a driven spur gear 160. As best shown in FIG. 3, pinion drive shaft 154 is rotatably supported by inner pinion bearings 162, disposed in bearing mount 110, and outer pinion bearings 164, disposed in pinion bearing recess 166 of outer wall 36. As shown therein, an opening 168 also is provided in inner wall 34 to allow passage therethrough of pinion drive shaft 154. Driven spur gear 160 is arranged concentrically with stabilizing tube 62, and is secured relative thereto by conventional means, such as by friction fit, mating notches, key in key-way, etc. A spacer 77, such as an aluminum disk, also may be provided between driven spur gear 160 and outer stabilizing bearing 76 to maintain a clearance between driven spur gear 160 and outer wall 36.

Pinion drive shaft 154 is arranged for rotation about an axis parallel to axis CL of stabilizing tube 62. Moreover, pinion drive shaft 154 also is arranged orthogonal to the common rotational axis. Thus, it will be appreciated that pinion bevel gear 156 continuously will engage ring bevel gear 146 as pay-off station 12 is rotated about the common rotational axis. Moreover, proper selection of the number of cogs on ring bevel gear 146, pinion bevel gear 156, pinion spur gear 158 and driven spur gear 160 provides one rotation of stabilizing tube 62, cantilever arm 56 and product reel 26 about orthogonal axis CL for each rotation of pay-off station 12 about the common rotational axis.

In the preferred embodiment, pinion bevel gear 156 and pinion spur gear 158 each are composed of a sturdy material, most preferably steel, and driven spur gear 94 is composed of a strong, lightweight material, most preferably a fibrous plastic. However, those skilled in the art will readily appreciate that other compositions may be selected based on the particular stranding application. Furthermore, other means, such as individual motors, can be provided for rotating the reel support member.

In operation, a conductor strand payed off from product reel 26 is fed inward toward the common rotational axis, in a direction substantially orthogonal thereto. As described above, stabilizing tube 62 is arranged so that its rotational axis (centerline CL) is substantially orthogonal to the common rotational axis. Cantilever arm 56 is arranged with an off-set relative to orthogonal axis CL (e.g., to the right side as seen in FIG. 4) and is raked to one side (e.g., to the left side as seen in FIG. 3). As discussed in greater detail below, this arrangement pays off a conductor strand in a direction radially inward, substantially along a line orthogonal to the common rotational axis, thereby minimizing tension produced during pay-off from product reel 26.

As best shown in FIG. 3, as a conductor strand is payed-off product reel 26, the feed angle will vary over an angle $\beta$, from the outer radius R of product reel 26 to its inner radius r. It will be appreciated that the maximum variation of feed angle from CL may be minimized by selecting the amount of rake of cantilever arm 56 so that the rotational axis CL passes half way between the outer radius R and inner radius r of product reel 26. Moreover, it will be appreciated that minimizing the variation of this feed angle from orthogonal axis CL will minimize bowing due to centrifugal forces, and will minimize any risk of friction between the payed off strand and stabilizing tube 62. Likewise, as best shown in FIG. 4, as a conductor strand is payed off product reel 26, its feed angle also will oscillate over an angle as it is fed from side to side of product reel 26. Thus, it will be appreciated that the maximum variation of feed angle from CL may be minimized by selecting the amount of offset of cantilever arm 56 so that the rotational axis CL passes half way between the two sides of product reel 26. Moreover, it will be appreciated that minimizing the variation of this feed angle from orthogonal axis CL also will minimize bowing due to centrifugal forces, and will minimize any risk of friction between the payed off strand and stabilizing tube 58.

Referring again to FIG. 2, in one embodiment strander 10 includes twelve pay-off stations 12 arranged in a ferris-wheel configuration. As shown therein, pay-off stations 12 rotate clockwise about the common rotational axis. Simultaneously, each product reel 26 is rotated clockwise about its orthogonal axis CL (when viewed looking radially inward toward the common rotational axis). Moreover, as shown therein, rotation of each product reel 26 is indexed such that as each pay-off station 12 passes any given point around the common rotational axis, its respective product reel 26 will be rotated to the same degree relative to its respective orthogonal axis. For example, as shown in FIGS. 1 and 2, rotation of product reels 26 of respective pay-off stations 12 disposed on opposite sides of mounting disk 13 are indexed such that they are 180° out of synchronization, and product reels 26 of respective adjacent pay-off stations 12 are indexed such that they are out of synchronization by 30°. If product reels 26 of respective pay-off stations 12 all simultaneously rotate without any indexing, it may create a vibration or wobble along the common rotational axis, as the collective mass of product reels 12 oscillates above and below a plane defined by the respective orthogonal axes CL. Thus, it will be appreciated that this indexed configuration substantially eliminates vibration in the direction of the common rotational axis due to rotation of product reels 26 about the orthogonal axis.

It further will be appreciated that the embodiment of FIGS. 1 to 4 provides a strander for selectively generating a multi-strand cable having from 2 to 13 strands. For example, a two-strand cable may be generated by selectively providing a conductor strand from each of only two pay-off stations arranged on opposite sides of the mounting disk. A three-strand cable can be generated by adding a core strand to the prior arrangement. Alternatively, a three-strand cable can be generated by selectively providing a conductor strand from each of only three pay-off stations arranged at intervals of 120 degrees around the mounting disk (e.g., every fourth position). Similar variations of cored and core-less multi-strand cables can be generated by selectively providing conductor cables from each of only four pay-off stations (e.g., every 90 degrees or third position around the mounting disk) or six pay-off stations (e.g., every other position around the mounting disk). It will be appreciated that such geometrical arrangements provide balance around the mounting disk which substantially prevents vibrations due to centrifugal forces during rotation.

Other geometrical arrangements also provide radial balance. For example, an eight-strand (or nine-strand, with core) cable can be generated by selectively providing a conductor strand to each pay-off station in four sets of adjacent pay-off station pairs, each pair being separated by a non-operational single pay-off station arranged at 90 degree intervals around the mounting disk. Likewise, a nine-strand (or ten-strand, with core) cable can be generated by selectively providing a conductor strand to each pay-off station in three sets of three adjacent pay-off stations, each set being separated by a non-operational single pay-off stations arranged at 120 degree intervals around the mounting disk. Moreover, it will be appreciated that each of these multi-strand cables can be generated by the present strander by simply selecting the number of conductor strands, without changing the configuration of the strander.

As described above, a multi-strand cable generally is provided by winding conductor strands about a core strand. For purposes of this application, a core strand may be a single strand or a previously generated multi-strand cable. Accordingly, the present invention also is directed to multi-strand cables having multiple overlays, e.g., a single core strand and two layers of conductor strands applied consecutively thereto. Such consecutive overlays can be effected by drawing a "core" strand twice through the strander depicted in FIGS. 1 to 4. Alternatively, a strander of the present invention could comprise a pair of mounting disks arranged coaxially with the common rotational axis, each disk having one or more pay-off stations radially mounted thereon. Moreover, this "stacking" is not limited to two mounting disks. A strander of the present invention could comprise three or more coaxially disposed mounting disks.

Figure 5:
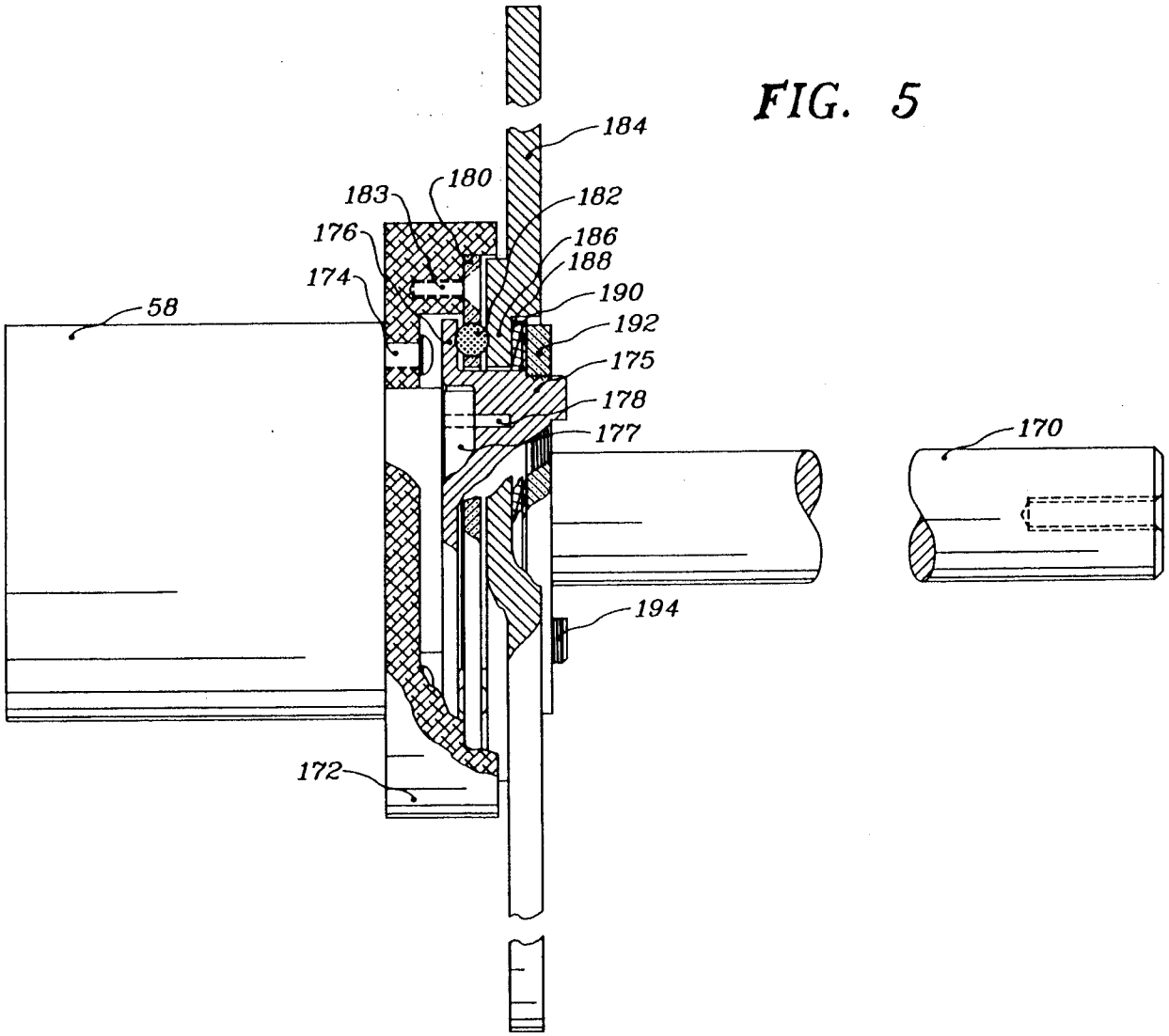
FIG. 5 is an enlarged perspective view, shown in partial cross-section, of an alternative embodiment of a pay-off assembly, including a flywheel and coupling structure for stabilizing the rotational moment of a product reel.

The present embodiment, including the pay-off reel and tension brake assembly, has been found to provide satisfactory performance at normal rotational speeds. However, for rotational speeds up to about 300 rpm, it has been found that vibration may be generated in the pay-off assembly, and that such vibration may degrade the quality of the strand product. Specifically, the various rotational forces to which the reel is subjected may cause an alternating torque to be applied to the reel on its axis of pay-off rotation. This varying torque will alternately increase and retard the otherwise steady-state pay-off speed of the reel, thereby changing the tension on the strand being drawn off the reel. In addition to causing vibration, this alternating change in tension of the strand may deleteriously affect the end product, especially in the case of a fiber optic product. Referring, however, to FIG. 5, there is shown an alternative embodiment of the pay-off assembly that eliminates an induced vibration in the rotational speed of the product reel.

As shown in FIG. 5, a stabilizing mechanism is provided in the form of a torque differential device for driving a flywheel in a rotational direction opposite to that of the reel. The mechanism is depicted partly in cross-section wherein a boss or housing 172 is formed in cantilever arm 56 for supporting the tension brake assembly 58. The brake is attached to the boss by screws 174. A hub 175, having a hub race 176 extending radially therefrom, is coaxially mounted on the product reel shaft 170. The shaft extends from a rotor 177 of the tension brake 58, so that hub 175 is partially housed in boss 172. The tension brake rotor 177 rotates with the shaft, and the hub 175 may be rotationally indexed to the tension brake rotor 177 by conventional means, e.g., by pin 178. A torque differential in the form of a stationary ball cage 180, including balls 182, is coaxially secured to boss 172 by screws 183, so that balls 182 engage race 176 of hub 175. An inertial flywheel 184 including a flywheel race 186 is coaxially disposed for rotation about hub 175, so that flywheel race 186 engages balls 182 on a side opposite to their engagement with hub race 176. Flywheel 184 is retained in a spinning relation about hub 175 by a needle bearing cage 188, which is biased thereagainst by a washer 190 and a bearing nut 192 which is threaded onto the hub 175. Flywheel race 186 should be provided on both sides thereof with a hard surface suitable for bearing engagement. The hub may be provided with dogs 194 extending outwardly therefrom for being received in a mating slot in the wall of product reel 26.

It will be appreciated that inertial flywheel 184 will be driven by the balls 182 to rotate in the direction opposite to that of the shaft 170. Accordingly, those skilled in the art will recognize that the rotation of hub 175 (and thus product reel 26) is coupled to inertial flywheel 184 through stationary ball cage 180 and balls 182, so that any torque tending to cause a change in angular momentum in product reel 26 will be balanced by a torque tending to cause a substantially equal change in angular momentum in inertial flywheel 184. For this reason, inertial flywheel 184 may be composed of any material suitable for providing an equivalent mass moment of inertia to that of the product reel 26 and the elements which rotate therewith. More particularly, in the present embodiment it has been found that both the mass and moment of inertia should be matched. By means of this structure, alternating changes in torque applied to the product reel as a result of rotational forces are substantially eliminated, thereby eliminating vibrations which would otherwise occur, and eliminating variations in tension on the strand during steady-state operation of the machine.

As an alternative to the use of ball bearings in the torque differential used for driving the flywheel, such differential can be provided by gears.

It therefore will be appreciated that the above-described strander achieves all of the objects and advantages of present invention. Initially, the present strander generates a twist neutralized multi-strand cable by synchronizing rotation of the product reel with rotation of the pay-off station about the common rotational axis. Bowing due to centrifugal forces is substantially eliminated because each conductor strand is fed radially inward, in a direction substantially orthogonal to the common rotational axis, wherein the strand bends over a single guide 28, and experiences bending forces over a relatively short distance. This provides the desirable result of reducing the amount of tension to which the strand is subjected. Bowing due to windage also is substantially eliminated because the payed-off conductor strand is fed through a stabilizing tube and housing, which shields it from windage. The strander is compact because it does not require an extended cradle, as used on prior stranders. Production speed also may be increased to about 300 RPM, because increasing rotational speed does not substantially increase tension in the conductor strands due to bowing.

Numerous other embodiments and modifications will be apparent to those skilled in the art and it will be appreciated that the above description of a preferred embodiment is illustrative only. It is not intended to limit the scope of the present invention, which is defined by the following claims.

I claim:

1. A strander for generating a multi-strand cable, comprising:

at least one pay-off station spaced radially from a common rotational axis for rotation about the common rotational axis, each said pay-off station including a rotatable product reel support member and a product reel supported by said product reel support member for paying-off a strand, each said product reel being arranged to spin about a respective reel axis that is perpendicular to and offset from a product pay-off line that intersects the common rotational axis;

means for rotating each said pay-off station about the common rotational axis;

a driving mechanism for each said product reel support member, for rotating each said product reel support member about an axis disposed along said product pay-off line; and at least one guide member disposed adjacent the common rotational axis, wherein a strand payed-off from each said product reel is fed in an inward direction along said product pay-off line to a respective guide member, and is then fed against said guide member to change its direction so that the strand is fed along said common rotational axis and is wound thereabout.

2. The strander recited in claim 1, wherein said driving mechanism for each said product reel support member rotates each said support member one rotation for each rotation of said pay-off station about the common rotational axis, wherein a self neutralizing cable is generated.

3. The strander recited in claim 1, wherein said pay-off station rotating means comprises a mounting disk arranged for rotation about the common rotational axis, each said pay-off station being disposed on said mounting disk at a common circumference.

4. The strander recited in claim 3, wherein said pay-off station rotating means further comprises a flange gear assembly, wherein said driving mechanism for said product reel support member comprises a pinion gear assembly in meshed cooperation with said flange gear assembly, and wherein rotation of each said pay-off station about the common rotational axis is synchronized with rotation of each said product reel support member about a respective axis.

5. The strander recited in claim 4, wherein each said pay-off station further comprises a stabilizing tube arranged concentrically with said product reel support member; and axis and supported on said product reel support member for concentric rotation about said product reel support member.

6. The strander recited in claim 5, wherein rotation of said stabilizing tube is synchronized with rotation of said product reel support member.

7. The strander recited in claim 6, wherein said product reel is positioned on a cantilever arm for rotation synchronously with said stabilizing tube.

8. The strander recited in claim 7, further comprising a tension brake and axle assembly for rotatably mounting said product reel to said cantilever arm, and for controlling the tension in a conductor strand payed-off from said product reel.

9. The strander recited in claim 5, wherein said pinion gear assembly comprises a pinion drive shaft having a pinion bevel gear fixed to said drive shaft and arranged in mesh cooperation with said flange gear assembly, and a pinion spur gear in mesh cooperation with a driven spur gear, and wherein said driven spur gear is arranged concentrically with said stabilizing tube and is secured thereto.

10. The strander recited in claim 5, wherein said stabilizing tube is removably supported for rotation within said product reel support member by bearing means.

11. The strander recited in claim 10, wherein said bearing means comprises ball bearings and a snap ring and bearing nut, said snap ring cooperating with a recess in said product reel support member to securely support and register said stabilizing tube within said product reel support member.

12. The strander recited in claim 1, wherein the number of pay-off stations is at least two, and wherein rotation of each said product reel support member is indexed relative to each other said product reel support member.

13. The strander recited in claim 12, wherein the number of pay-off stations is twelve.

14. The strander recited in claim 1, wherein each said pay-off station further comprises:

means for balancing a moment of angular momentum of said product reel, including a flywheel arranged coaxially with said product reel, and coupling means connected between said flywheel and said product reel for causing said flywheel to rotate in a direction opposite to the direction of rotation of said product reel, wherein a change in angular momentum in said product reel is balanced by a change in angular momentum in said flywheel.

15. The strander recited in claim 1, wherein each said pay-off station further comprises:

a stabilizing mechanism for balancing a change in angular momentum of said product reel in the direction of pay-off rotation of the reel, said stabilizing mechanism including a flywheel arranged coaxially with said product reel, said flywheel being mounted for rotation in a direction opposite to the direction of pay-off rotation of said product reel, a bearing device coupled to rotate with said reel and coupled to said flywheel to cause said rotation of the flywheel in the direction opposite to that of said product reel, said flywheel having a mass and a moment of inertia which are matched to the reel and all elements rotating therewith on said pay-off axis, wherein a change in angular momentum in said product reel is counteracted by a substantially equal change of angular momentum in said flywheel.

16. The strander recited in claim 1, wherein said product reel support member axis is orthogonal to said common rotational axis.

17. The strander recited in claim 1, wherein said product reel has a maximum radius corresponding to a fully wound strand product and a minimum radius corresponding to a fully payed-out strand product, and wherein said product reel support member supports said reel in a position so that a strand payed-off said reel is centered on said product reel support member axis when an amount of product to be payed-off said reel is about halfway between said maximum and minimum radius.

18. A method for generating a self neutralized multi-strand cable, comprising the steps of:

providing a first strand disposed along a central rotational axis;

spacing at least one pay-off assembly away from the central rotational axis, and rotating each said pay-off assembly about the central rotational axis, each said pay-off assembly including a product reel for paying off a strand to be wound about the first strand;

spinning each product reel about its reel axis to pay off a conductor strand from each said product reel in a radial direction toward the central rotational axis; and revolving each said product reel, about a radial axis which is orthogonal to the reel axis and orthogonal to the central axis, wherein each reel is revolved once for each rotation of its respective pay-off assembly about the central rotational axis, and wherein said payed-off strand is wound about the central rotational axis and about the first strand without a backtwist.

19. A method for stranding a multi-strand cable, comprising the steps of:

radially spacing from a common rotational axis at least one pay-off station for rotation about the common rotational axis, each said pay-off station including a rotatable product reel support member and a product reel supported by said product reel support member for paying-off a strand, each said product reel being arranged to spin about a respective reel axis that is perpendicular to and offset from a product pay-off line that intersects the common rotational axis;

rotating each said pay-off station about the common rotational axis;

driving each said product reel support member to rotate each said product reel support member about an axis disposed along said product pay-off line; and paying off a strand from each said product reel, and feeding each said strand in an inward direction along said product pay-off line to a respective guide member, against said guide member to change the feed direction, and then along said common rotational axis.

20. The method recited in claim 19, wherein said driving step includes the step of rotating each said support member one rotation for each rotation of said pay-off station about the common rotational axis to generate a self neutralizing cable.

21. The method recited in claim 19, wherein the driving step includes the step of synchronizing the rotation of each of said product reel support members about its respective axis with the rotation of each of said pay-off stations about the common rotational axis.

* * * * *